US006102372A

United States Patent [19]

Gersemsky et al.

[11] Patent Number: 6,102,372

[45] Date of Patent: Aug. 15, 2000

[54] ROPE ARRANGEMENT FOR THE SUSPENSION OF ATTACHMENT MEANS AT A CARRYING DEVICE ARRANGED ABOVE IT

[75] Inventors: Udo Gersemsky, Herdecke; Alfred Fänger, Wetter, both of Germany

[73] Assignee: Mannesmann AG, Düsseldorf, Germany

[21] Appl. No.: 09/121,219

[22] Filed: Jul. 23, 1998

[30] Foreign Application Priority Data

Jul. 23, 1997 [DE] Germany ..... 197 32 451

[51] Int. Cl.[7] ..... B66D 1/26

[52] U.S. Cl. ..... 254/278; 212/274

[58] Field of Search ..... 254/278, 290; 242/602.1; 212/274, 71, 330, 331

[56] References Cited

U.S. PATENT DOCUMENTS

| | | | |
|---|---|---|---|
| 505,065 | 9/1893 | Shaw | 212/274 X |
| 3,899,083 | 8/1975 | Flessner et al. | 212/274 |
| 4,949,855 | 8/1990 | Foit | 212/274 |
| 5,603,420 | 2/1997 | Swanson | 212/274 |
| 5,673,804 | 10/1997 | Weiss et al. | 254/278 X |
| 5,765,703 | 6/1998 | Shiwaku | 254/278 X |

FOREIGN PATENT DOCUMENTS

| | | | |
|---|---|---|---|
| 141 817 | 5/1980 | Germany . | |
| 4142778 | 6/1993 | Germany | 212/274 |
| 43 25 946 | 2/1995 | Germany . | |
| 44 25 777 | 2/1996 | Germany . | |
| 22 80 883 | 2/1995 | United Kingdom . | |

*Primary Examiner*—Donald P. Walsh
*Assistant Examiner*—Emmanuel M. Marcelo
*Attorney, Agent, or Firm*—Cohen, Pontani, Lieberman & Pavane

[57] ABSTRACT

A rope arrangement having carrying ropes guided downward in pairs at four corner points of an imaginary four-cornered shape at a carrying device. One of the carrying ropes extends from one of the corner points of one transverse side of the imaginary four-cornered shape and another of the carrying ropes extends from the other corner point of the same transverse side. The carrying ropes are at a spread angle relative to one another and in a plane extending parallel to the transverse side. Spaced fastening locations of the pairs of carrying ropes provided at an attachment device lie in at least one vertical plane which intersects the transverse sides transversely in the center. In order to achieve a damping of load oscillations in any direction, two carrying ropes are respectively fastened to the corner points and accordingly to the fastening locations of the carrying device and the planes associated with the pairs of carrying ropes are inclined relative to one another at an angle (β) with respect to each transverse side.

6 Claims, 8 Drawing Sheets

17
17
9
4
4
β
β
4k2
4i2
4i1
4k1
6d
6c
6b
6a
16d
16c
16b
16a
8
4l
4k
4j
4i

ROPE ARRANGEMENT FOR THE SUSPENSION OF ATTACHMENT MEANS AT A CARRYING DEVICE ARRANGED ABOVE IT

BACKGROUND OF THE INVENTION

1. Field of the Invention

The present invention is directed to a rope arrangement for the suspension of an attachment device from a carrying device located above, especially a longitudinal carrier in a lifting mechanism, such as a travelling crane, travelling trolley and the like, typically having rope drums with grooves from which carrying ropes are guided downward in pairs.

2. Description of the Related Art

German reference DE 44 25 777 C2 discloses a lifting mechanism with one or more rope drums which dampens load oscillations by a special suspension of the load carrier. For this purpose, two rope drums are arranged parallel to one another and associated with a travelling trolley. A rope groove is formed on each side of the rope drum center, having a right-hand winding on one side and a left-hand winding on the other side. A lifting rope is arranged in each rope groove. The lifting ropes are guided downward in pairs from each rope drum and each pair is fastened to a fastening location of a longitudinal carrier.

A lifting rope of the right-hand winding and a lifting rope of the left-hand winding, of each rope drum, run at an angle to one another in a plane extending parallel to the axis of the rope drum. The intersecting points of the pairs of lifting ropes are fastened to the load carrier at a distance. The fastening locations lie on a straight line in a plane which transversely intersects the centers of the rope rolls.

A disadvantage of the prior art is that the damping action is only effective in one independent direction.

SUMMARY OF THE INVENTION

The object of the present invention is to provide a rope arrangement for the suspension of a sling or an attachment, especially in a lifting mechanism, which achieves a substantially complete damping relative to load oscillations in any direction, while maintaining a low overall construction height.

To attain this object, carrying ropes are guided downward in pairs from corner points of the carrier device or from rope drums, and attached to fastening locations. The planes associated with each of the pairs of carrying ropes are inclined relative to one another at an angle $\beta$ in relation to a respective carrier device side or rope drum axis. The carrying ropes of the pair run in a plane extending parallel to the rope drum axis at a spread angle $\alpha$ relative to one another. The fastening locations of the pairs of carrying ropes, at the attachment carrier lie, in at least one vertical plane transverse to the longitudinal axis of the rope drum.

In a first embodiment of the present invention, two carrying ropes are fastened to each of the fastening parts of the carrying device. The planes associated with the pairs of carrying ropes, with respect to each transverse side, are inclined at an angle ($\beta$) relative to one another. In this fundamental arrangement of the suspension, there are virtually no load oscillations. Although the suspension is constructed of ropes, the suspension behaves under loads similar to a metal construction formed of rigid elements.

In a second embodiment of the present invention, two rope drums are arranged parallel to one another. The drums have rope grooves in which the carrying ropes are guided. The grooves are formed on both sides of the rope drum center with right-hand windings on one side and with left-hand windings on the other side. The carrying ropes are guided downward in pairs from each rope drum, and are fastened to attachment means. For each pair, the carrying rope of the right-hand winding and the carrying rope of the left-hand winding run at a spread angle ($\alpha$) relative to one another in a plane extending parallel to the rope drum axis. All of the fastening locations of the pairs of carrying ropes are provided at a distance on the attachment means and lie in at least one vertical plane which transversely intersects the centers of the rope drums. Two carrying ropes are located directly next to one another are guided in the rope grooves of the rope drums. The planes associated with the pairs of carrying ropes are inclined relative to one another at an angle ($\beta$) with respect to each rope drum. In this way, a lifting mechanism is provided in which carrying ropes are used and wherein it is possible to transport loads virtually without oscillations.

Advantageously, in order to achieve a constant spread angle, the pitch of the rope grooves is identical in both the right-hand winding portion and the left-hand winding portion and is independent from the height position of the load.

The attachment means are preferably constructed as a longitudinal carrier.

In order to compensate for different contact points of the carrying ropes located directly next to one another in the rope grooves, the longitudinal carrier is configured, and the fastening locations are selected, so that the lengths of the carrying ropes between the contact points on the rope drum and the contact points on the longitudinal carrier are substantially equal.

In a simple advantageous embodiment of the present invention, the fastening locations at the longitudinal carrier lie in a straight line.

Under certain conditions, it is preferrable that the fastening locations of the pairs of carrying ropes at the attachment means, viewed in the direction transverse to the longitudinal axis of the rope drums, alternately lie in one of two vertical planes which lie at a distance from one another and which intersect the rope roll transversely.

In order to achieve a uniform rope loading, spacing of the fastening locations at the attachment means is predetermined depending on height of the attachment means.

In another advantageous embodiment of the present invention, a motor adjusts the spacing, as for example, by a displacement of the fastening locations along a rail.

In an alternative embodiment of the present invention, every fastening location of the pairs of carrying ropes is arranged at a travelling mechanism at the longitudinal carrier. Each travelling mechanism is guided by a rail extending in the longitudinal direction of the carrier, allowing adjustment of the spacing of the fastening locations by motor or automatically.

Controls are economized, in particular, when the rails directly succeeding one another in the direction of the longitudinal axis of the rope drums are inclined at an angle ($\beta$) relative to one another by pairs. The spacing of the fastening locations associated with a respective height is thereby adjusted automatically. Advantageously, the traveling mechanism is always positioned so that forces no longer occur in the longitudinal direction of the rails, the longitudinal axis of the traveling mechanism and the longitudinal direction of the rope being at a right angle to one another.

In a simple form of this embodiment an angle of inclination of the pairs of rails relative to one another is identical to the spread angle.

In a third embodiment of the present invention, at least one rope drum has the rope grooves arranged at both sides of the rope drum center, with the right-hand windings on one side and with the left-hand windings on the other side. The carrying ropes are guided in the grooves. The carrying ropes are fastened to attachment means, the ropes being guided downward. The carrying ropes run in a plane extending parallel to the rope drum axis at the spread angle. At least one pair of deflection rollers, which are at a distance from one another, is arranged on either side of the rope drum parallel to its longitudinal axis so as to be located opposite to the right-hand windings and the left-hand windings. A pair of carrying ropes is guided over the deflection rollers, so that on each side of the rope drum a carrying rope of one deflection roller and a carrying rope of a second deflection roller form a pair. The carrying ropes of a pair run in a plane extending parallel to the rope drum axis at the spread angle relative to one another, so that the planes of both pairs of carrying ropes of each side of the rope drum are inclined at the angle (β) relative to one another. The fastening locations of the pairs of carrying ropes at the attachment means lie in at least one vertical plane transverse to the longitudinal axis of the rope drum. This embodiment makes it possible to use only one rope drum, through the use of deflection rollers, resulting in a kind of "rigid" suspension.

In order to be able to place the carrying ropes on the rope drum such that they are offset relative to one another, the present invention provides that the fastening locations of the pairs of carrying ropes at the attachment means viewed in the direction transverse to the longitudinal axis of the rope drum alternately lie in one of two vertical planes which are at a distance from one another and which intersect the rope roll transversely.

In another embodiment the deflection rollers are swivelably mounted, making it possible to use conventional deflection rollers.

The carrying ropes are loaded uniformly in the longitudinal direction when the swiveling axis extends transverse to the longitudinal axis of the rope drum.

The loading of the rope can be made more homogeneous when the swiveling axis extends parallel to the longitudinal axis of the rope.

The different rope drums can advantageously be connected with one another via couplings.

The arrangement with respect to the rope drums can also be selected in such a way that a plurality of rope drums are used, the rope drums being arranged parallel to one another.

According to the present invention, the attachment means are constructed as a longitudinal carrier.

The various features of novelty which characterize the invention are pointed out with particularity in the claims annexed to and forming a part of the disclosure. For a better understanding of the invention, its operating advantage, and specific objects attained by its use, reference should be had to the drawing and descriptive matter in which there are illustrated and described preferred embodiments of the invention.

DETAILED DESCRIPTION OF THE PRESENTLY PREFERRED EMBODIMENTS

Figure 1:
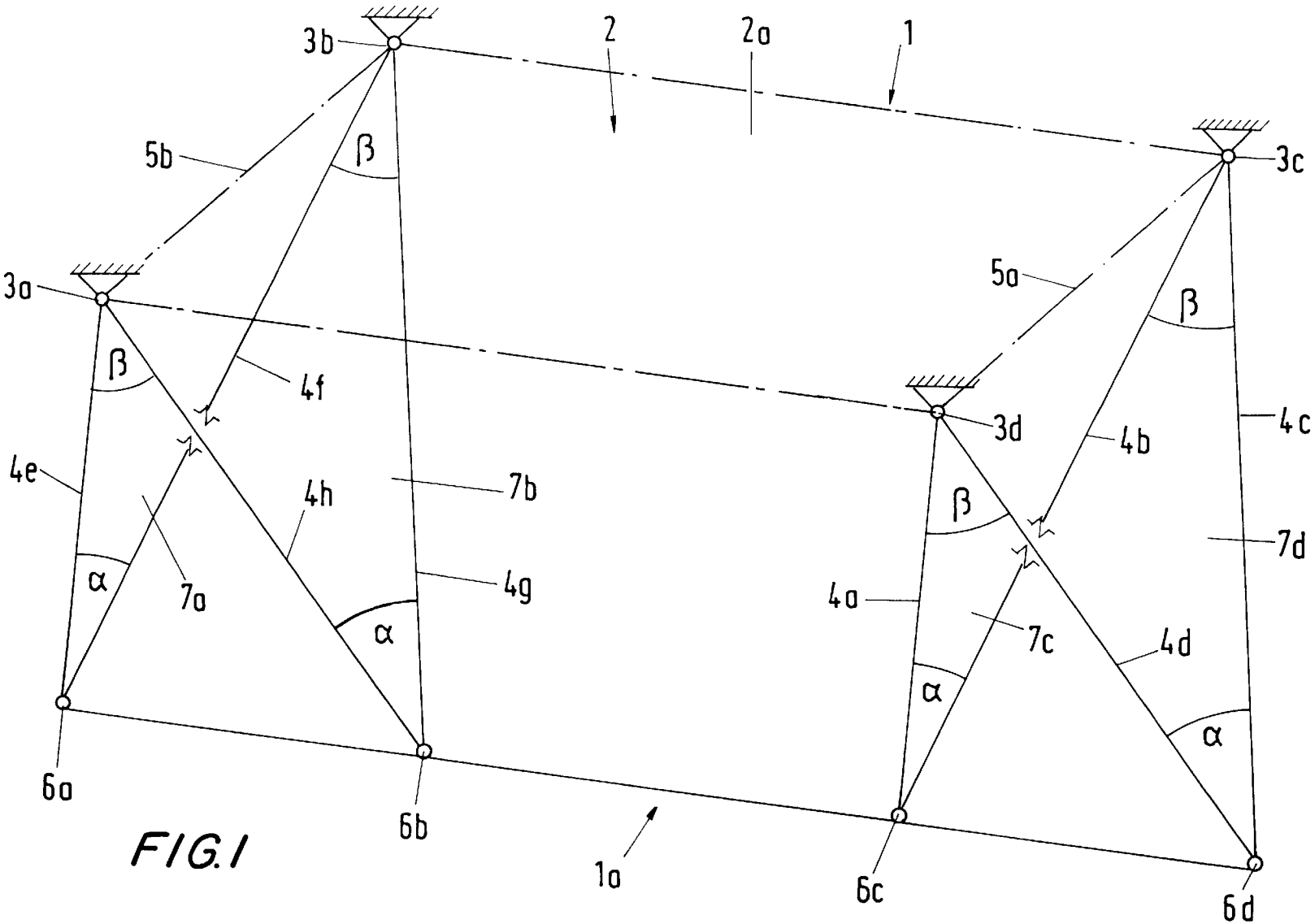
FIG. 1 shows a first embodiment of a rope arrangement of the present invention.

A rope arrangement 1 for the suspension of attachment means 1*a* at a carrying device arranged above it is shown in a simplified, schematic form in FIG. 1. As can be seen from FIG. 1, the rope arrangement 1 defines an imaginary four-cornered shape 2 in the form of a rectangle 2*a* with four corner points 3*a* to 3*d* from which carrying ropes 4*a* to 4*h* are guided downward in pairs. The corner points 3*a*, 3*b* and 3*c*, 3*d* define respective transverse sides 5*b*, 5*a* of the rectangle 2*a*. One of the carrying ropes is fastened to one of the corner points 3*a*, 3*b*, 3*c*, 3*d* and another of the carrying ropes is fastened to the other corner point respectively 3*b*, 3*a*, 3*d*, 3*c* of the same transverse side 5*a*, 5*b*. Each such pair of ropes is connected to one of a fastening location 6*a* to 6*d* arranged at attachment means 1*a*.

As is shown in FIG. 1, the pairs of carrying ropes 4*a*, 4*b* and 4*c*, 4*d* and 4*e*, 4*f* and 4*g*, 4*h* extend at a spread angle α relative to one another in a plane 7*a* to 7*d* extending parallel to the respective transverse side 5*a*, 5*b*. The spread angle α may not exceed a predetermined allowable value based on current construction regulations. The fastening locations 6*a* to 6*d* are arranged at a distance from one another and lie on an imaginary straight line and accordingly in a vertical plane which transversely intersects centers of the transverse sides 5*a*, 5*b*. Two of the carrying ropes 4*a*, 4*d* and 4*b*, 4*c* and 4*e*, 4*h* and 4*f*, 4*g* are respectively fastened to the corner points 3*d*, 3*c*, 3*a* and 3*b* of the rectangle 2*a* and accordingly at the fastening locations 6*c*, 6*d* and 6*c*, 6*d* and 6*a*, 6*b* and 6*a*, 6*b*, of the carrying device. The planes 7*c* and 7*d* as well as 7*a* and 7*b* associated with the pairs of carrying ropes 4*a*, 4*d* and 4*b*, 4*c* or 4*c*, 4*h* and 4*f*, 4*g* are inclined relative to one another at angle p with respect to each of the transverse sides 5*a*, 5*b*.

The rope arrangement 1 of the type described above has the advantage that a load fastened to the attachment means la pulls the carrying ropes 4*a*–4*h* downward due to gravitational force, so that oscillation of the load is effectively prevented.

Figure 2:
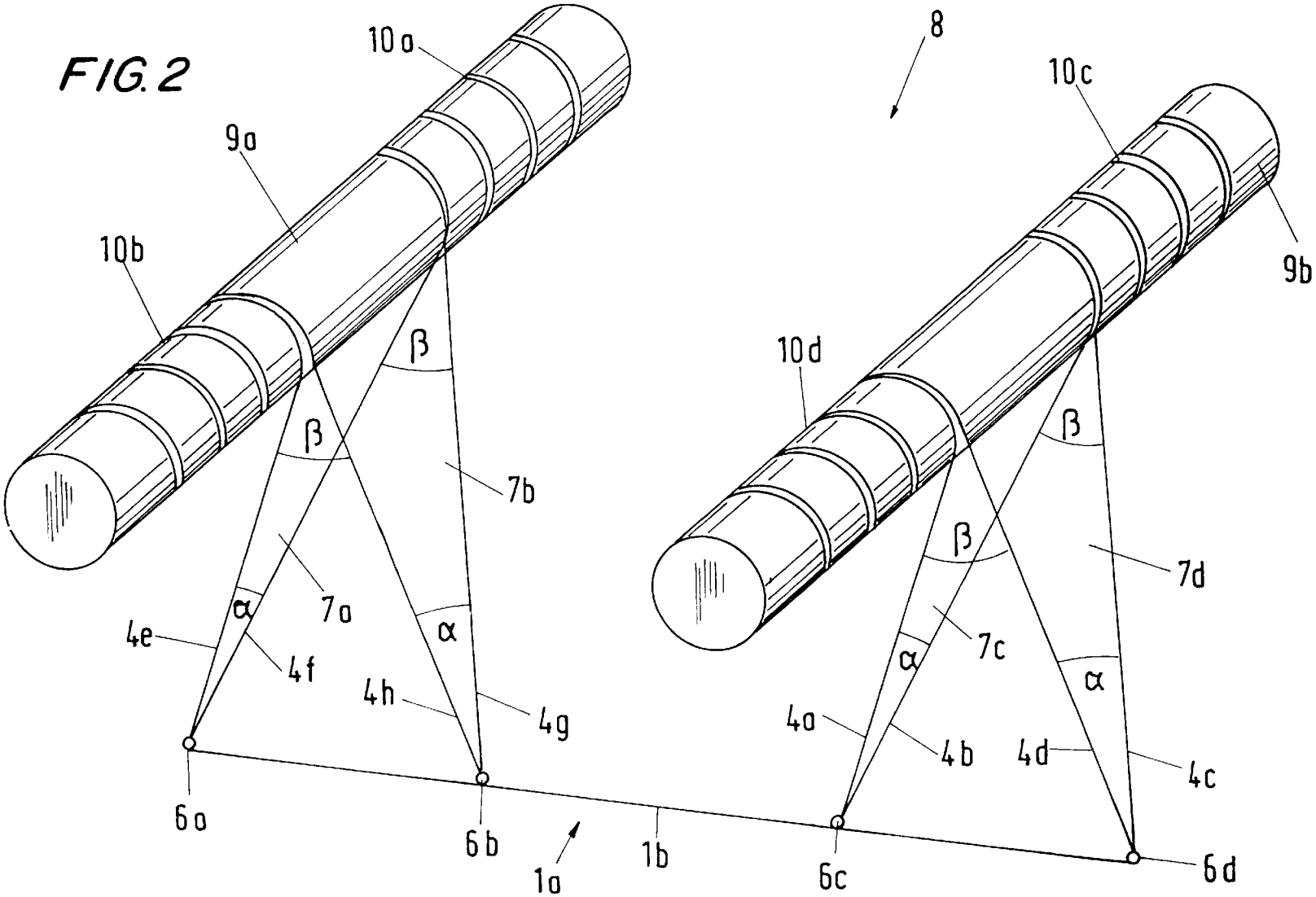
FIG. 2 shows a lifting mechanism with the rope arrangement of FIG. 1.

FIG. 2 shows, in a schematic view, the rope arrangement 1 for the suspension of attachment means la at a lifting mechanism 8. The rope arrangement 1 corresponds to that in FIG. 1. As is shown in FIG. 2, the lifting mechanism 8 includes two rope drums 9*a*, 9*b*, which are arranged parallel to one another and on which the carrying ropes 4*a*–4*h* are guided. Rope grooves 10*a*–10*d* are formed, for guidance, on either side of the rope drum 9*a*, 9*b* centers. A right-hand winding is formed on one side of the rope drum 9*a*, 9*b* center and a left-hand winding is formed on the other side of the rope drum 9*a*, 9*b* center, as shown schematically in the drawing. Two carrying ropes 4*f* and 4*g*, 4*e* and 4*h*, 4*a* and 4*d*, 4*b* and 4*c* which lie directly adjacent to one another are guided, respectively, in the rope grooves 10*a*, 10*b*, 10*d* and 10*c*.

It is possible to guide two of the carrying ropes 4*a*–4*b* in an individual rope groove 10*a*–10*d*. Of course, two of the rope grooves 10*a*–10*d* can be located directly adjacent to one another and arranged so as to be offset relative to one another in the longitudinal direction in which pairs of the carrying ropes 4*f* and 4*g*, 4*e* and 4*h*, 4*a* and 4*d*, 4*b* and 4*c* lying directly adjacent to one another are then guided.

As is shown in FIG. 2, a carrying rope 4*b*–4*c* of the right-hand winding and a carrying rope 4*a*–4*d* of the left-hand winding are guided downward as a pair 4*e* and 4*f*, 4*h* and 4*g*, 4*a* and 4*b*, 4*d* and 4*c*, and in a plane 7*a*, 7*b* and 7*c*, 7*d* extending parallel to the axis of the rope drum 9*a*, 9*b*, specifically so as to extend at the spread angle α relative to one another. The planes 7*a*–7*d* associated with the pairs of carrying ropes 4*e* and 4*f*, 4*h* and 4*g*, 4*a* and 4*b*, and 4*d* and 4*c* are inclined at the angle β relative to one another.

Further, FIG. 2 shows that the carrying ropes that are guided downward in pairs are fastened to fastening locations 6*a*–6*d*, wherein the fastening locations 6*a*, 6*b*, 6*c*, 6*d* of the pairs of carrying ropes lie on a straight line which extends in at least one vertical plane intersecting the rope drums 9*a*, 9*b* transversely in the middle.

Figure 4:
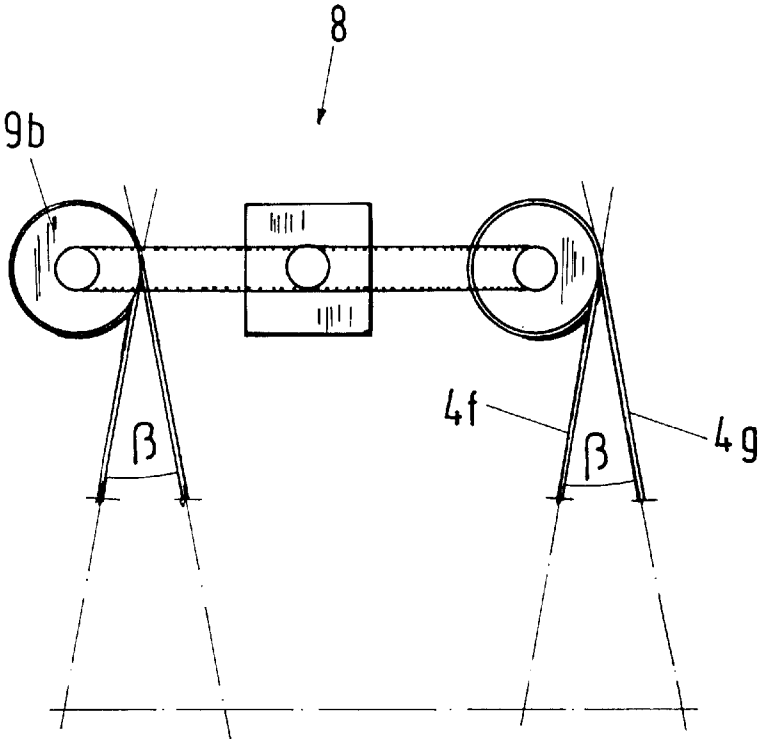
FIG. 4 shows a side view of the embodiment of FIG. 2.
Figure 3:
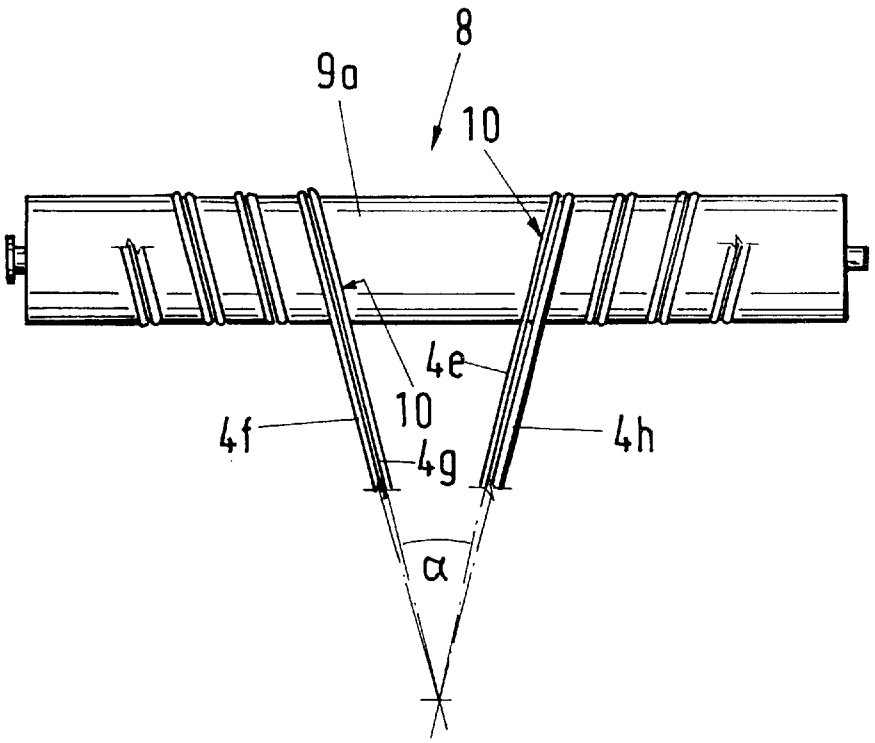
FIG. 3 shows a front view of the embodiment of FIG. 2.

FIG. 3 and FIG. 4, respectively, show a front view and a side view of the rope drums 9*a*, 9*b* of the lifting mechanism 8 shown in FIG. 2. It can be seen from FIG. 3 that the pitch of the rope grooves 10*a*–10*d* is identical in the right-hand winding section as well as in the left-hand winding section. As a result, the spread of the carrying ropes, i.e., the angle α of spread, remains approximately the same independent of the height position of the attachment means 1*a*.

The attachment means 1*a* must, of course, have a minimum extension. Furthermore, the attachment means 1*a* are configured as a longitudinal carrier 1*b*.

Problems arise however in a lifting mechanism 8 according to FIG. 2 and FIG. 4 especially due to the use of rope drums, because the length of the carrying ropes 4*a*–4*b* between the contact point 12*a*, 13*a* (FIGS. 5 and 6) on the rope drum 9*a*, 9*b* and the fastening location 6*a*–6*d* on the longitudinal carrier lb changes depending on height.

Figure 5:
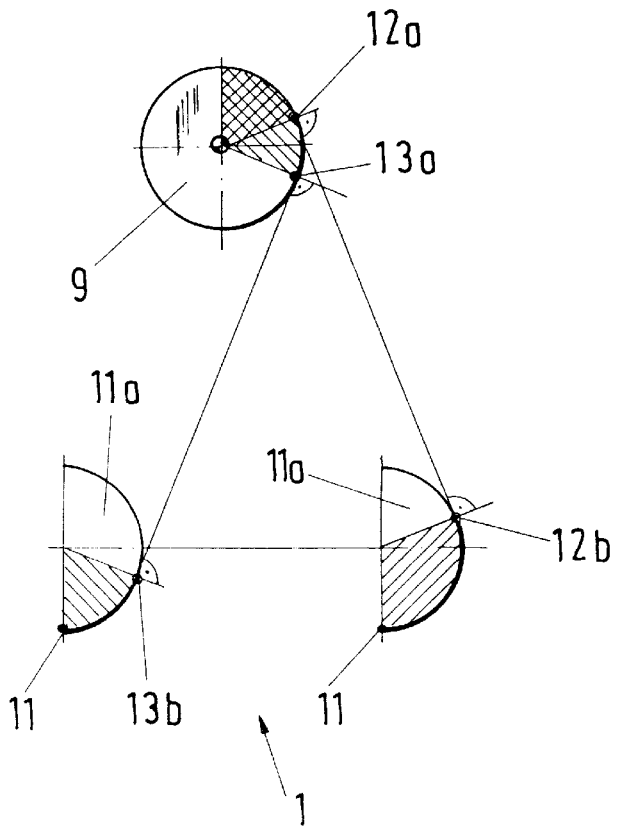
FIGS. 5 and 6 show schematic views of a second embodiment of the present invention.
Figure 6:
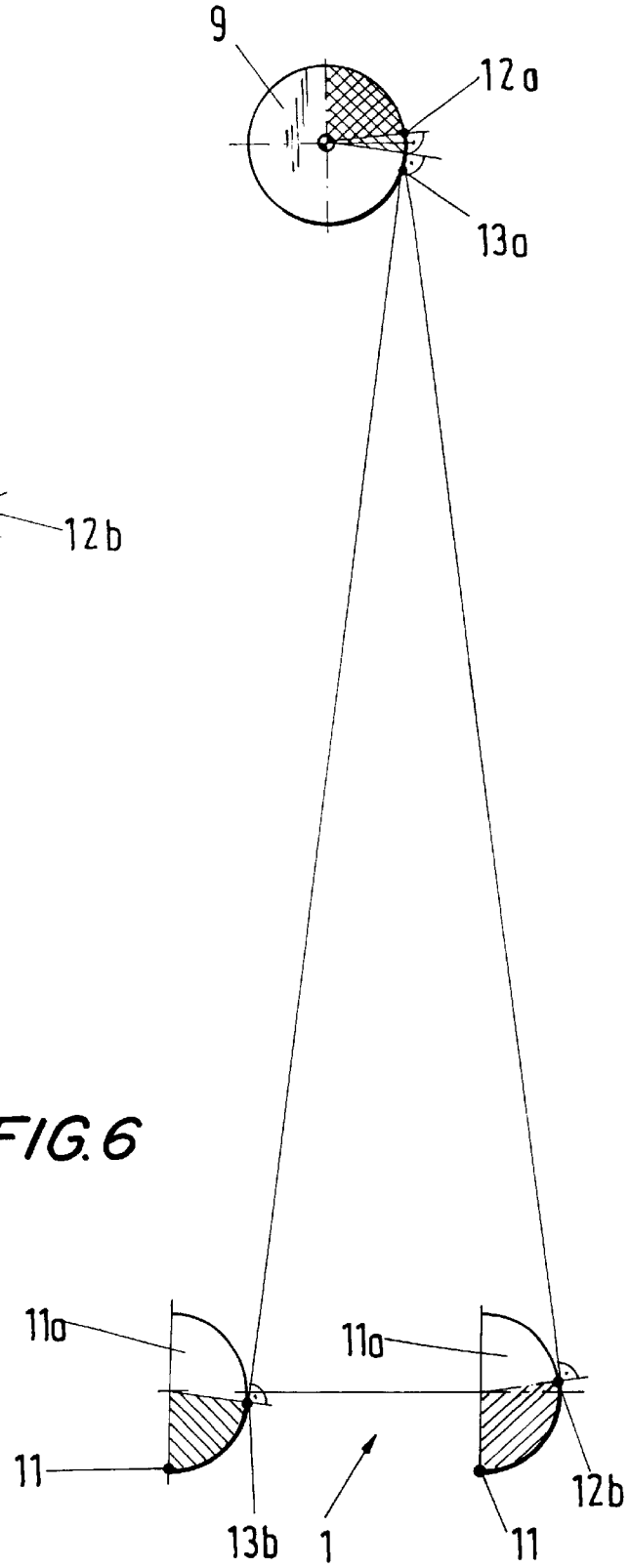

In a further advantageous embodiment, in order to overcome this problem, the longitudinal carrier 1*b* is provided with semicircular disks 11*a* as is shown schematically in FIG. 5 and FIG. 6. The ends of the carrying ropes 4*a*–4*h* are fastened to locations 11 at the semicircular disks 11*a*. The carrying ropes 4*a*–4*h* can be tensioned in a simple manner by rotating the semicircular disks 11*a* about the center of the respective full circles. As shown in FIG. 5 and FIG. 6, the differences in lengths of the carrying ropes 4*a*–4*h*, in such a configuration of the longitudinal carrier 1*b*, are automatically compensated for height, i.e., at any height the lengths of the carrying ropes 4*a*–4*h* are substantially identical between contact points 12*a* and 12*b* as well as contact points 13*a* and 13*b*.

Of course, the fastening locations of the pairs of carrying ropes 4*a*–4*h* at the attachment means 1*a*, seen in the direction transverse to the longitudinal axis of the rope drums 9*a*, 9*b*, can also alternately lie in one of two vertical planes which lie at a distance from one another and which intersect the rope drums 9*a*, 9*b* transversely.

Figure 7:
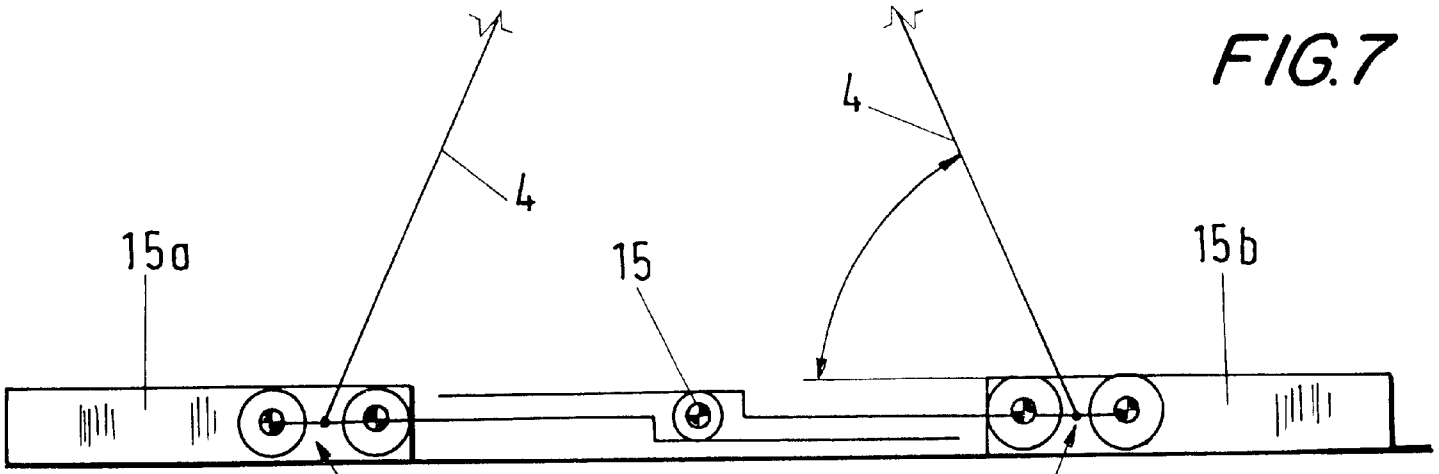
FIGS. 7 and 8 show a third embodiment of the present invention.
Figure 8:
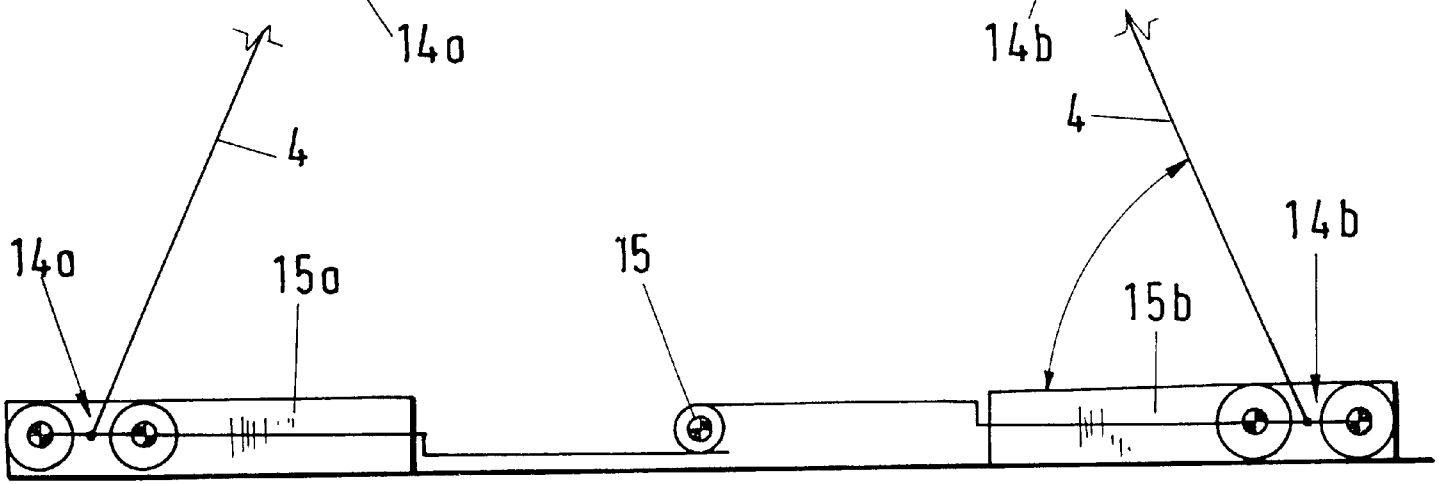
Figure 9:
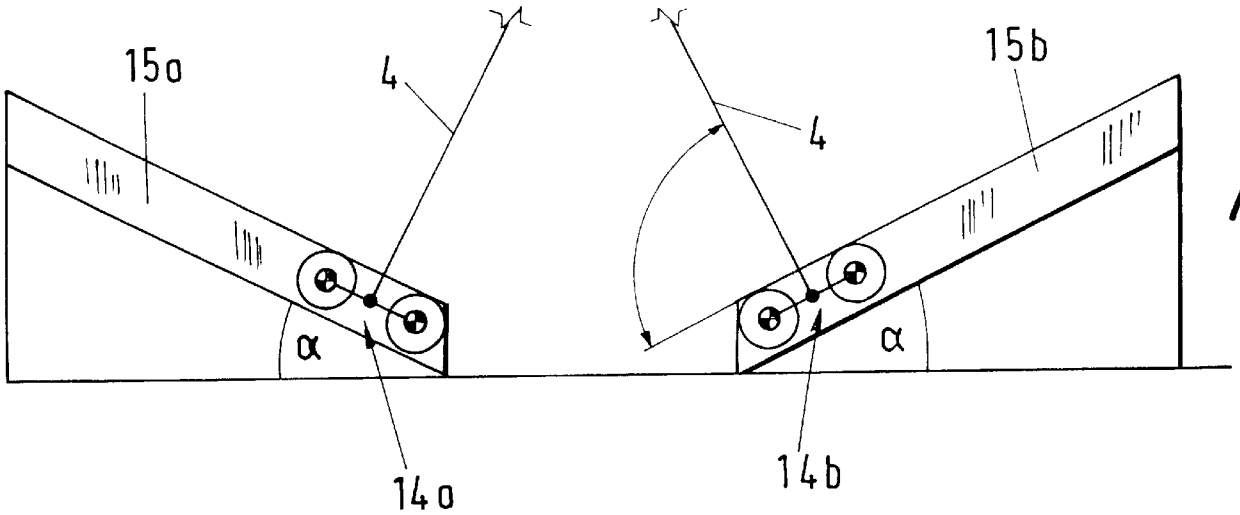
FIGS. 9 and 10 show a fourth embodiment of the present invention.
Figure 10:
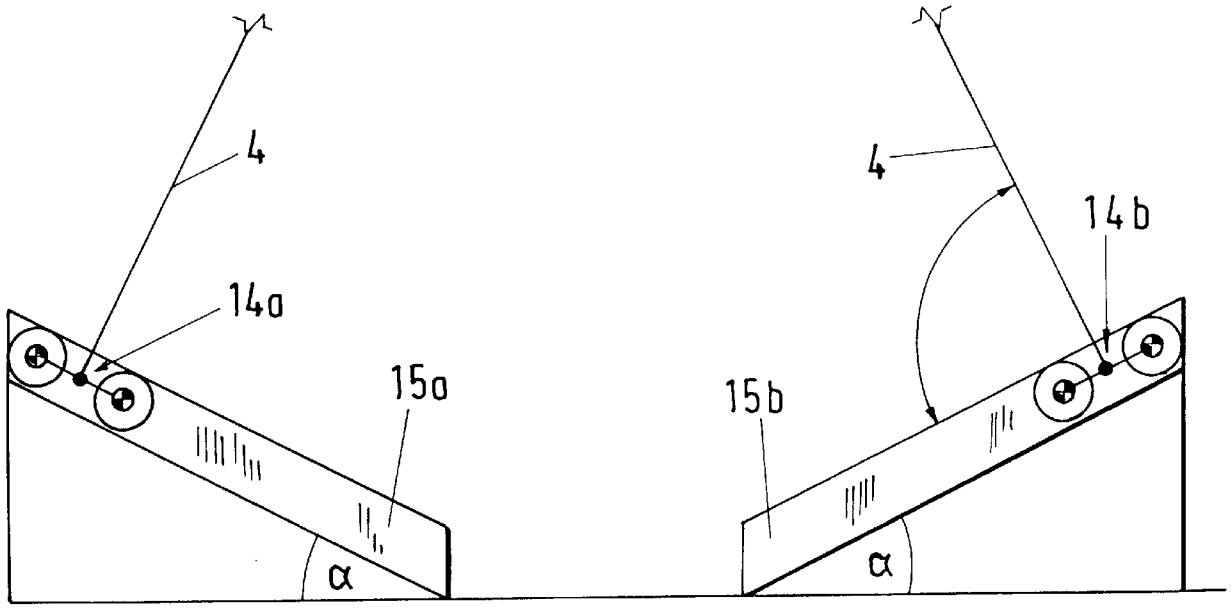

Another embodiment for advantageously changing the distance between the fastening locations 6*a*–6*d* depending on the height of the attachment means 1*a*, and accordingly for achieving a constant spread angle β, is shown in FIG. 7 and FIG. 8 and in FIG. 9 and FIG. 10. In this embodiment, the carrying ropes 4*a*–4*h* are fastened to traveling mechanisms 14*a*, 14*b* which are movable by a motor 15. In order to guide the traveling mechanisms 14*a*, 14*b*, guide rails 15*a*, 15*b* are provided which extend in the longitudinal direction of the attachment means 1*a*.

In a particularly simple configuration of this embodiment, the rails 15*a*, 15*b* directly follow one another in the direction of the longitudinal axis of the rope drums 9*a*, 9*b* and are arranged so as to be inclined relative to one another in pairs, so that the angle of inclination of the pairs of rails relative to one another is equal to angle β.

Figure 11C:
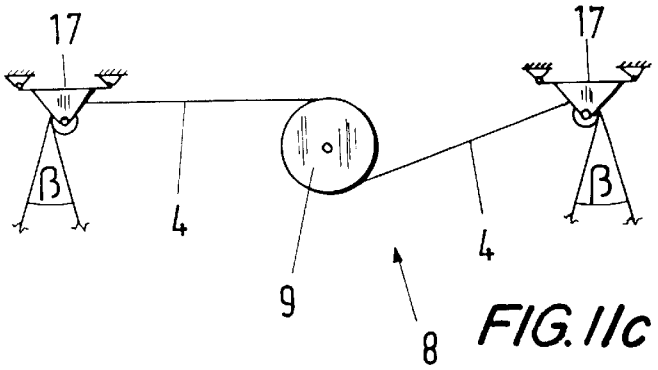
FIG. 11*c* shows a partial side view of the embodiment of FIG. 11*a;*
Figure 11A:
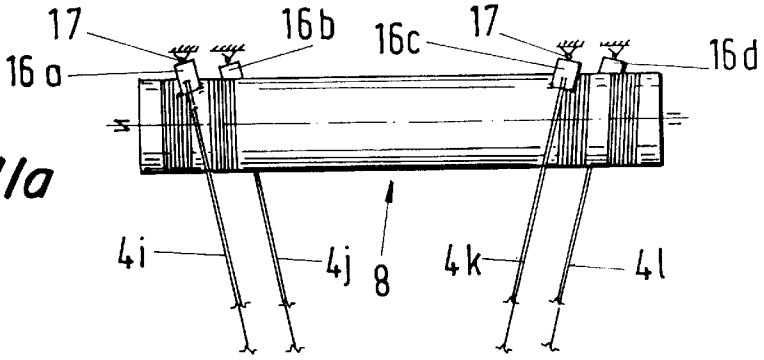
FIG. 11*a* shows a partial front view of a fifth embodiment of the present invention.
Figure 11B:
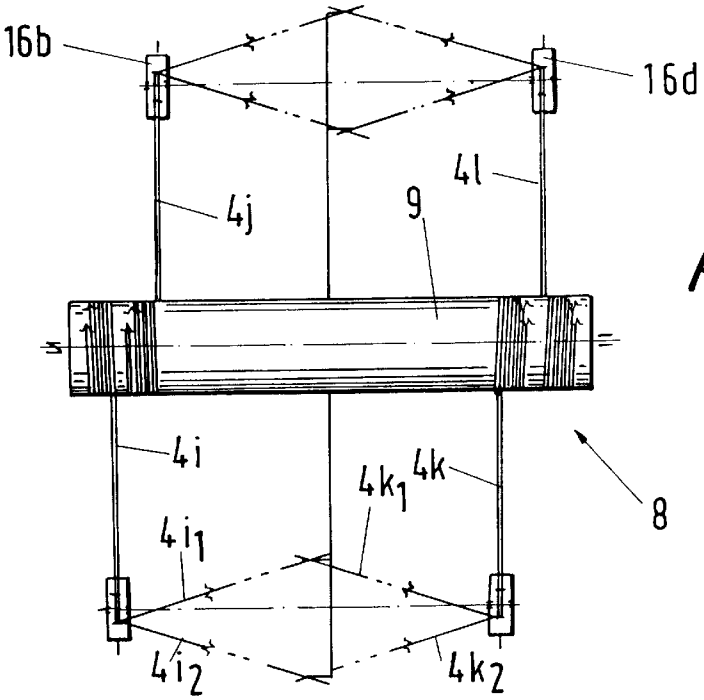
FIG. 11*b* shows a partial top view of the embodiment of FIG. 11*a;*

FIGS. 11*a*, 11*b*, 11*c* and 12*a*, 12*b* show another embodiment of the rope arrangement 1. In FIGS. 11*a*, 11*b*, 11*c* the rope arrangement 1 for the suspension of attachment means 1*a* at a lifting mechanism 8 with a rope drum 9, is combined with swivelably arranged deflection rollers 16*a* to 16*d*. As is shown by the front view in FIG. 11*a*, on either side of the rope drum 9 center, two right-hand windings are provided on one side and two left-hand windings are provided on the other side in the form of rope grooves 10*a*–10*d* in which carrying ropes 4*i*–4*l* are guided. The deflection rollers 16*a* to 16*d* are at a distance from one another and are arranged in pairs on both sides of the rope drum 9. The deflection rollers 16*a*–16*d* are arranged parallel to the rope drum 9 longitudinal axis and are located opposite from the right-hand windings and left-hand windings in each case, as can be seen from the top view in FIG. 11*b*. The deflection rollers 16*a*–16*d* are swivelably mounted, the swiveling axis 17 extending parallel to the longitudinal axis of each of the respective carrying ropes 4*i*–4*l*. Each of the pairs of the carrying ropes 4*i* to 4*l* is guided over the deflection rollers 16*a*–16*d*, wherein, on each side of the rope drum 9, the carrying rope 4*i*–4*l* of one of the deflection rollers 16*a*–16*d* and the carrying rope 4*i*–4*l* of the other of the deflection rollers 16*a*–16*d* form a pair, e.g., 4*i*1 and 4*k*1, etc. Every pair extends at a spread angle α in a plane extending parallel to the rope drum 9 axis, wherein the planes of the two pairs of carrying ropes 4 of each side of the rope drum 9 are inclined at an angle β relative to one another, FIG.

Figures 12A, 12B:
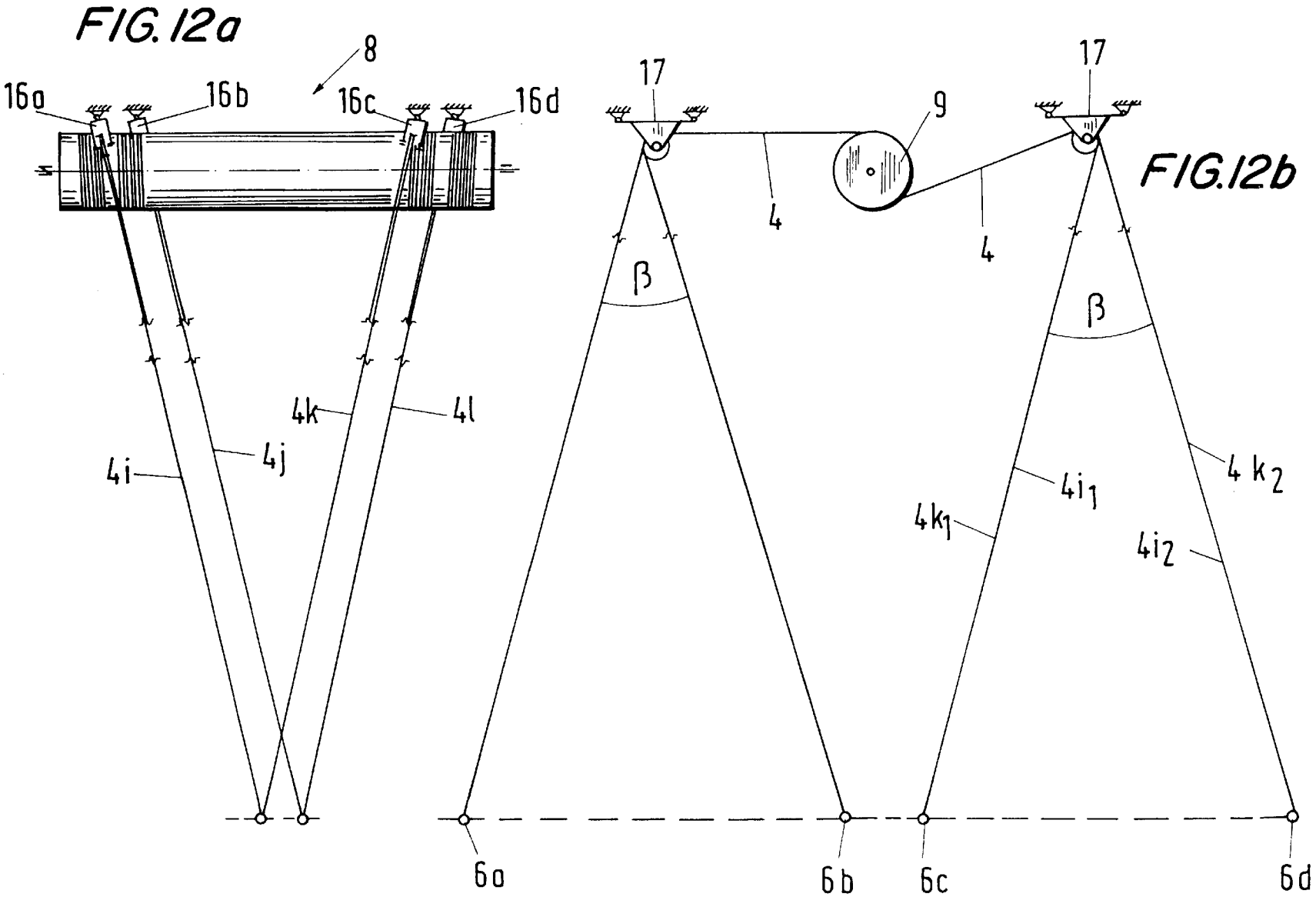
FIG. 12*a* shows a front view of the embodiment of FIG. 11*a;*.
FIG. 12*b* shows a side view of the embodiment of FIG. 11*a.*

As can be seen particularly from FIGS. 12*a* and 12*b*, the carrying ropes 4 are guided downward and are fastened as a pair at their intersection point at the longitudinal carrier 1*b*. The fastening locations 6*a*–6*d* of the pairs of carrying ropes 4 at the longitudinal carrier 1*b*, viewed in the direction transverse to the longitudinal axis of the rope drum 9, are arranged alternately in one of two vertical planes which intersect the rope drum 9 transversely at a distance from one another.

Of course, it is also possible to use a plurality of rope drums instead of one rope drum 9 so that the rope drums are arranged coaxially to one another or also parallel to one another. In a coaxial arrangement, the rope drums can be connected with one another via couplings, so that a rope drum 9 is formed from a plurality of individual rope drums.

Of course, it is also possible for the fastening locations of the pairs of carrying ropes at the longitudinal carrier 1*b* to lie in only one vertical plane transverse to the longitudinal axis of the rope drum 9.

The invention is not limited by the embodiments described above which are presented as examples only but can be modified in various ways within the scope of protection defined in the appended patent claims.

We claim:

1. A rope arrangement for suspending attachment means from a carrying device located above the attachment means, comprising:

four corner points positioned at the carrying device so as to describe a four-cornered shape having two oppositely arranged transverse sides, each of the transverse sides having a center;

carrying ropes guided downward in pairs from each of the four corner points, one of the carrying ropes extending from one of the corner points of one of the transverse sides and another of the carrying ropes extending from an other of the corner points of the one transverse side, the two carrying ropes being at a spread angle relative to one another and in a plane extending parallel to the same transverse side; and fastening locations provided at the attachment means, the pairs of carrying ropes being attached thereto, the fastening locations being at a distance from one another so as to a lie in at least one vertical plane transversely intersecting the centers of the transverse sides, the carrying ropes being fastened in respective pairs to each of the corner points and accordingly to the fastening locations so that planes associated with each of the pairs of carrying ropes are inclined relative to one another at an angle β with respect to each transverse side.

2. A rope arrangement for suspending attachment means in a lifting mechanism, comprising:

attachment means;

carrying ropes;

two rope drums arranged parallel to one another, each of the rope drums having a center and having rope grooves in which the carrying ropes are guided, the rope grooves being formed on both sides of the rope drum center, having right-hand windings on one side and left-hand windings on the other side, the carrying ropes being guided downward in pairs from each of the rope drums, wherein one of the carrying ropes of the right-hand winding and one of the carrying ropes of the left-hand winding run at a spread angle relative to one another in a plane extending parallel to the rope drum axis; and fastening locations provided at the attachment means, the pairs of carrying ropes being attached thereto, all the fastening locations being at a distance from one another so as to a lie in at least one vertical plane transversely intersecting the centers of the rope drums, two of the carrying ropes located directly next to one another being guided in the rope grooves so that planes associated with the pairs of carrying ropes are inclined relative to one another at an angle β with respect to every one of the rope drums.

3. The rope arrangement according to claim 2, wherein the rope grooves of the right-hand winding have a pitch identical to a pitch of the rope grooves of the left-hand winding so that the spread angle of the carrying ropes remains substantially identical independent of a height position of a load.

4. The rope arrangement according to claim 2, wherein the attachment means is a longitudinal carrier.

5. The rope arrangement according to claim 4, wherein the carrying ropes have a length, the carrying ropes meeting the rope drum at a contact point on the rope drum and meeting the longitudinal carrier at a contact point on the longitudinal carrier, the longitudinal carrier and the fastening locations being configured so that the lengths of the carrying ropes extending from the rope drum contact points to the longitudinal carrier contact points are substantially identical for each carrying rope.

6. The rope arrangement according to claim 4, wherein the fastening locations at the longitudinal carrier lie in a straight line.

* * * * *